US007223097B2

(12) United States Patent
Perez

(10) Patent No.: US 7,223,097 B2
(45) Date of Patent: May 29, 2007

(54) DISK-LIKE PIEZOELECTRIC LIGHTER WITH A SAFETY LOCK

(75) Inventor: Jose Perez, Kowloon (HK)

(73) Assignee: Polyconcept Hong Kong Limited, Kowloon (HK)

( * ) Notice: Subject to any disclaimer, the term of this patent is extended or adjusted under 35 U.S.C. 154(b) by 200 days.

(21) Appl. No.: 11/008,984

(22) Filed: Dec. 13, 2004

(65) Prior Publication Data

US 2006/0035187 A1 Feb. 16, 2006

(30) Foreign Application Priority Data

Aug. 16, 2004 (CN) ..... 2004 2 00851763

(51) Int. Cl.
*F23D 11/36* (2006.01)
*F23Q 2/08* (2006.01)

(52) U.S. Cl. ..... 431/153; 431/255; 431/132; 431/344

(58) Field of Classification Search ..... 431/344, 431/153, 255, 254; *F23Q 7/26, 7/24; F23D 11/36*
See application file for complete search history.

(56) References Cited

U.S. PATENT DOCUMENTS 6,086,358 A * 7/2000 Potskhishvili et al. ..... 431/153
6,287,109 B1 9/2001 Hirota
6,527,542 B1 * 3/2003 Chen ..... 431/153
6,540,507 B1 * 4/2003 Yang ..... 431/153
6,669,465 B2 12/2003 Yang
6,682,341 B2 * 1/2004 Pan et al. ..... 431/153
2002/0132201 A1 9/2002 Zhang
2002/0177091 A1 * 11/2002 Chen ..... 431/153
2003/0068594 A1 4/2003 Yang

* cited by examiner

*Primary Examiner*—Josiah Cocks
*Assistant Examiner*—Chuka C Ndubizu
(74) *Attorney, Agent, or Firm*—Rabin & Berdo, P.C.

(57) ABSTRACT

A disk-like piezoelectric lighter with a safety lock includes a casing, a gas emitting nozzle, a piezoelectric unit, a sliding member and a safety lock. The safety lock comprises an arcuate resilient arm; a sliding cap having an cover portion, a pair of stands, a pair of branch arms, a lateral blocking stopper and a guiding slot; a safety button which comprises a base portion and a button portion and which is mounted slidably in the guiding slot in such a manner that the base portion comes into contact with the resilient arm to allow the resilient arm to be shifted from the locked position that the resilient arm is blocked up by the blocking stopper to the unlocked position that the blocking up is released to ignite the piezoelectric lighter.

7 Claims, 2 Drawing Sheets

DISK-LIKE PIEZOELECTRIC LIGHTER WITH A SAFETY LOCK

BACKGROUND OF THE INVENTION

1. Field of the Invention

The present invention relates to a piezoelectric lighter, and more particularly to a disk-like piezoelectric lighter with a safety lock.

2. Description of Related Art

Some piezoelectric lighters are provided with a safety lock so as to prevent the piezoelectric lighters from being ignited accidentally or by children playing. Usually, the safety lock blocks an ignition cap of the piezoelectric lighter by a button, so that the ignition cap cannot therefore be moved. When igniting, there is a need to pre-operate the button to unlock the ignition cap before sliding down the ignition cap to ignite the piezoelectric lighter.

U.S. Patent Publication No. 2002/0132201A1 discloses a safety piezoelectric lighter having a safety arrangement which includes an ignition cap having a locker cavity; a locking unit comprising a locking latch extended from an inner wall of the casing and a locker arm disposed in the locker cavity of the ignition cap; an operation button comprising a slider locker slidably mounted on the ignition cap for moving the locker arm to an unlocked position; a resilient element disposed in the receiving cavity for applying an urging pressure against the locker arm so as to normally retain the locker arm in a locking position that the locker arm is biased against the locker latch to block up the ignition cap from being slid downwardly for ignition. In the unlocked position, the locker arm is moved away from the locking latch, so that the ignition cap is capable of being slid downwardly to ignite the piezoelectric lighter.

Another piezoelectric lighter with a safety lock is disclosed in U.S. Pat. No. 6,540,507 to John Jiin Chung Yang. The safety lock includes an ignition cap slidably mounted on the casing in a radially movable manner, a blocking stopper supported in the ignition cavity, a locking member including a locking latch disposed the ignition cavity and extended to a position that the locking latch is blocked by the blocking stopper, so as to lock up the ignition cap from ignition. In the unlocked position of the safety lock, the locking latch is moved away from the blocking stopper so as to release the blocking up of the ignition cap with respect to the blocking stopper, so that the ignition cap is capable of being slid sidewardly and downwardly to ignite the piezoelectric lighter.

The safety locks as mentioned above can eliminate an accidental ignition of the piezoelectric lighter, thereby providing a protection against fire. However, all of the locks are designed to provide workable structures for a slide-down ignition piezoelectric lighter integrally composed of a piezoelectric unit and an elongated casing characterized in that its height is much greater than its width, so that multiple relative locking or unlocking elements or units can be arranged in the ignition cap.

SUMMARY OF THE INVENTION

A main object of the present invention is to provide a disk-like piezoelectric lighter with a safety lock, i.e. a flat piezoelectric lighter in the form of a disk, which is provided with a safety lock that has a different structure from the prior art to block up the ignition motion of the ignition cap in order to prevent any sudden or unwanted ignition of the piezoelectric lighter.

Accordingly, in order to accomplish the above object, the disk-like piezoelectric lighter with a safety lock according to the invention includes:

a casing receiving a liquefied gas storage and an ignition cavity provided therein, an arcuate opening being provided on a circumferential wall of the casing which is opposite to the ignition cavity;

a gas emitting nozzle installed in the casing and communicated with the liquefied gas storage for controlling a flow of the gas;

a piezoelectric unit for generating piezoelectricity, comprising a frame-shaped piezoelectric member, an movable operating element extended upwards from the piezoelectric member and an ignition tip extended to a position that gets close to the gas emitting nozzle, wherein said piezoelectric unit is received in the casing and installed on the liquefied gas storage so that the ignition tip generates sparks to ignite the gas emitted from the gas emitting nozzle when the movable operating element is pushed down with respect to the piezoelectric member;

a sliding member having an end cover portion, an extension wall extended downwards in a vertical direction from the end cover portion and a pair of horizontal legs symmetrically extended out vertically from the extension wall, wherein said sliding member is movably mounted on the top of the piezoelectric unit or the operating element through the end cover portion in such a manner that the horizontal legs may be located movably up and down in a position that gets close to two opposite surfaces of the piezoelectric member; and a safety lock comprising:

a resilient arm being in the form of an arc and having an end secured on the wall of the casing at the side of the opening;

a sliding cap having an arcuate cover portion, a pair of forked stands extended downwards from the cover portion, a pair of branch arms each protruding outwardly from the side of the respective stand, a lateral blocking stopper located under the cover potion and between the two stands, and a guiding slot mounted on a top surface of the cover portion at the rear of the stopper, wherein said sliding cap is mounted in a slidable or rotatable manner on the two opposite side walls of the liquefied gas storage by means of the stands, and each of the two branch arms approaches or rests on the top end surfaces of the horizontal legs of the sliding member so that, when the stands are slid down, the branch arms may be shifted down in an arc movement, thus pushing the sliding member and by which driving the operating element to co-move vertically and downwardly to ignite the piezoelectric lighter; moreover, in the static or locked position of the lighter, the front portion of the resilient arm on the casing is located in a traveling way of one side surface of the blocking stopper to block up the sliding-down of the sliding cap;

a safety button comprising a base portion and a button portion protruding upwards from the middle of the base portion, wherein said safety button is mounted slidably up and down in the guiding slot of the sliding cap by means of the button portion, and the base portion is positioned behind the sliding cap to allow the bottom surface of the base portion to oppose to at a distance or come into contact with the arcuate surface of the resilient arm, whereupon the button portion is pressed down by a thumb force to cause the resilient arm to be shifted from the locked position that the resilient arm is blocked up by the blocking stopper to the unlocked position that the blocking up is released with respect to the blocking stopper.

In the disk-like piezoelectric lighter having a safety lock as mentioned above, the resilient arm secured on the wall of the casing at the side of the opening is boom-shaped, a gap is defined by each of two long side walls of the resilient arm and the edge of the arcuate opening on the casing, in which the stands are located movably, respectively.

In the disk-like piezoelectric lighter having a safety lock as mentioned above, the sliding cap has a tab having a radian greater than those of the other portions on the cover portion at the rear of the guiding slot.

In the disk-like piezoelectric lighter having a safety lock as mentioned above, the resilient arm is made of plastic materials.

In the disk-like piezoelectric lighter having a safety lock as mentioned above, the casing may be oblate or flat-polygonal, except for disk-like.

In the disk-like piezoelectric lighter having a safety lock as mentioned above, the blocking stopper has an arcuate bottom surface.

It can be seen from the above that the piezoelectric lighter with a safety lock according the invention mainly adopts a resilient arm secured on the wall of the casing at the side of the opening, a lateral blocking stopper located under the cover portion of the sliding cap and between the two stands, a guiding slot mounted on a top surface of the cover portion and a safety button mounted slidably in the guiding slot. The safety button may come into contact with the resilient arm so that the resilient arm, when using a thumb force to press down the button portion and slide down the sliding cap, may be shifted from the locked position that the resilient arm is blocked up by the blocking stopper to the unlocked position that the blocking up is released.

The piezoelectric lighter according to the invention is compact and simple in structure, safe and reliable in application and small in size even if the lighter is fitted with the safety lock.

The above and other objects, advantages and novel features of the invention will become more apparent from the following detailed description with reference to the accompanying drawings.

DETAILED DESCRIPTION OF THE PREFERRED EMBODIMENT

Figure 1:
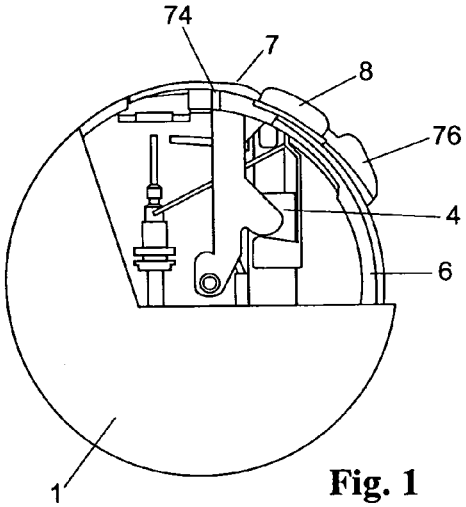
FIG. 1 is a partially sectional view of a piezoelectric lighter with a safety lock according to the invention, showing the relationship of parts such as an ignition button, a safety button and a piezoelectric unit in a static or locked position.
Figure 2:
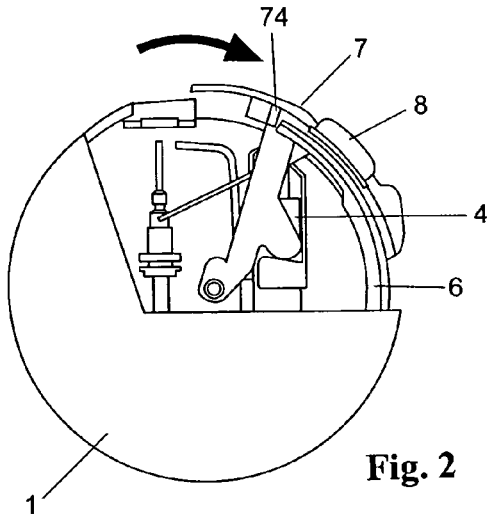
FIG. 2 is a partially sectional view of the piezoelectric lighter with a safety lock as shown in FIG. 1, showing the interrelation of the parts that are blocked up when the ignition button is slid down immediately before pressing down the safety button.
Figure 3:
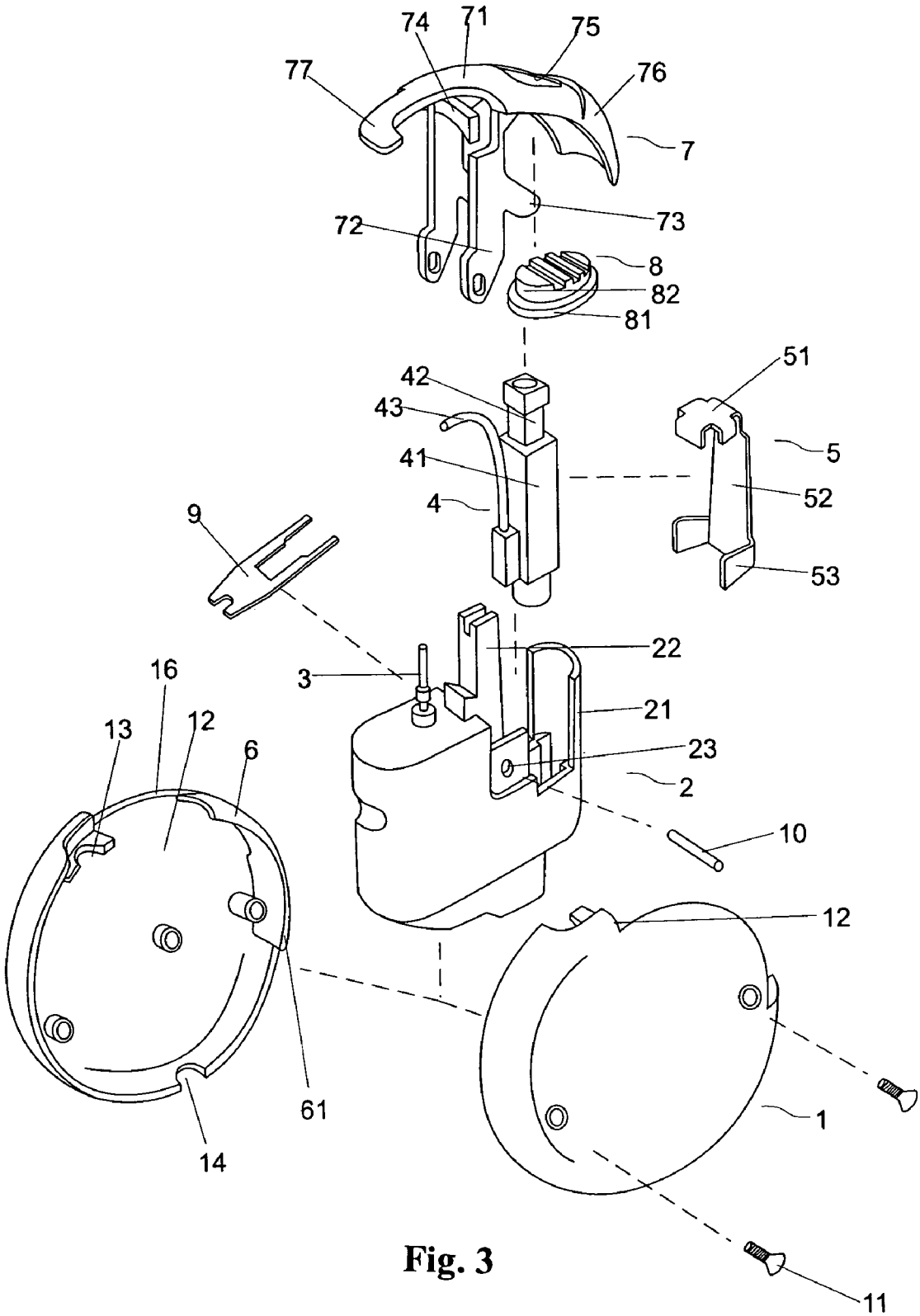
FIG. 3 is an exploded perspective view of the parts of the piezoelectric lighter with a safety lock as shown in FIG. 1.

With reference to FIGS. 1–3, a piezoelectric lighter with a safety lock in accordance with a preferred embodiment of the present invention is illustrated, which includes a casing 1, a liquefied gas storage 2, a gas emitting nozzle 3, a piezoelectric unit 4, a sliding member 5 and a safety lock comprising a resilient arm 6, a sliding cap 7, a safety button 8, a gas lever 9 and an axle 10 for installing the sliding cap 7. The casing 1, in the form of a disk, is composed of two substantially same discal semi-casings that are combined together by screws 11. However, the casing 1 may also be oblate or flat-polygonal and the like. The liquefied gas storage 2 is disposed at the lower portion of the casing 1, an ignition cavity is defined above the liquefied gas storage 2, and an arcuate opening 12 is provided on a circumferential wall of the casing 1 that is opposite to the ignition cavity.

The liquefied gas storage 2 herein is a conventional one, provided on a wall thereof with a semi-circular column 21 extended upwards from a bottom at one side of the storage, an installation pole 22 having a quadrangular cross section which is extended vertically and upwardly from the middle portion of the storage and has a groove defined on the top thereof and a pair of supporting boards 23 each of which has an axle hole and is disposed on respective side of the installation pole 22. Accordingly, a gas-filling hole 14 is provided on the casing 1 where the casing 1 is opposite to a gas valve of the liquefied gas storage 2 for filling with the liquefied gas, in order to fill the liquefied gas storage 2 with the gas through the hole 14.

The gas emitting nozzle 3 is installed in the casing 1 and on the liquefied gas storage 2, in communication with the liquefied gas storage 2 for controlling a flow of the gas. Accordingly, a fire hole 13 is provided on the casing 1 where the casing 1 is opposite in a straight line to the gas emitting nozzle 3, so that the flame is allowed to come out of the fire hole 13 when the combustible gas is lighted up.

The piezoelectric unit 4 for generating piezoelectricity or a piezoelectric effect is received in the casing 1 and positioned in the semi-circular column 21 of the liquefied gas storage 2. The piezoelectric unit 4 comprises a frame-shaped piezoelectric member 41 having a quadrangular top-hat, an operating element 42 movably installed in the piezoelectric member 41 and extended upwards, and an ignition tip 43 extended from the piezoelectric member 41 to a position that gets close to the gas emitting nozzle 3 and fixed by the groove of the installation pole 22. When the movable operating element 42 is pushed down with respect to the piezoelectric member 41, sparks are generated from the ignition tip 43 to ignite the combustible gas simultaneously emitted from the gas emitting nozzle 3 with the aid of the gas lever 9 which is connected between the operating element 42 and the gas emitting nozzle 3. The casing is provided with a fire hole where the casing 1 is opposite in a straight line to the gas emitting nozzle 3 and a gas-filling hole where the casing 1 is opposite to the gas valve of the liquefied gas storage 2 for filling with the liquefied gas.

The sliding member 5 comprises an end cover portion 51, an extension wall 52 extended downwards in a vertical direction from the end cover portion and a pair of horizontal legs 53 symmetrically extended out vertically from the extension wall. The sliding member 5 is movably mounted on the top of the piezoelectric unit 4 or the operating element 42 wherein the extension wall 52 is located between the piezoelectric member 41 and an inner wall of the semi-circular column 21, the end portions of the legs 53 are away from the inner wall of the semi-circular column 21 and may be located movably up and down in a position that gets close to two opposite surfaces of the piezoelectric member 41. Generally, the end cover portion 51 is a quadrangular, cross-shaped or circular hood top, and the extension wall 52 is a vertical extension plate of one side or one side wall of the end cover portion 51.

The safety lock comprises:

an arcuate resilient arm 6, which is made of plastic materials, or metal or non-metal resilient materials, and has an end secured on the wall of the casing 1 at the side of the opening 12 by means of adhering or welding, thereby being in the form of a boom. On the other hand, a gap is defined by each of two long side walls 61 of the resilient arm and the edge 16 of the arcuate opening on the casing.

The sliding cap 7 has an arcuate cover portion 71, a pair of forked stands 72 extended downwards from the rear surface of the cover portion 71, a pair of branch arms 73 each protruding outwardly and downwardly at an angle from the respective rear side of the stands 72, a lateral blocking stopper 74 located under the cover potion 71 and between the two stands 72, and a guiding slot 75 mounted on a wall of the cover portion 71 at the rear of the stopper 74. With the axle 10, the sliding cap 7 may be mounted rotatably on the supporting boards 23 of the two opposite side walls of the liquefied gas storage 2, wherein each of the stands 72 may be located in a movable manner in the respective gap defined by the side walls of the resilient arm 6 and the edge of the arcuate opening, and each of the two branch arms 73 may approach or rest on the top end surfaces of the horizontal legs 53 of the sliding member so that, when the stands 72 are slid down along the peripheral surface of the casing, the branch arms 73 may be shifted down in an radial movement along with the stands 72 to push the sliding member 5 which drives the operating element 42 to co-move vertically and downwardly to ignite the piezoelectric lighter. Moreover, when the lighter is in the static or locked position, the front portion of the resilient arm 6 on the casing 1 is located in the traveling way of an opposite surface on one side of the blocking stopper 74 to block up the sliding-down of the sliding cap 7. Also, there is a front portion 77 at the front end of the sliding cap 7 for covering the fire hole, it may cover the fire hole 13 of the casing 1 in the locked position. In order to facilitate the resilient arm 6 to run through below the blocking stopper 74, the bottom surface of the blocking stopper 74 has the same radian as that of the cross-section of the resilient arm 6.

The safety button 8 comprises a base portion 81 and a button portion 82 protruding upwards from the middle of the base portion. The button portion 82 reaches a height and has a peripheral surface in the form that is adapted to cooperate with the guiding slot 75. Therefore, the safety button 8 may be mounted slidably up and down in the guiding slot 75 of the sliding cap by the button portion 82, in such a manner that the base portion 81 is positioned behind the sliding cap 7 to allow the bottom surface of the base portion to oppose to at a distance or come into contact with the arcuate surface or the end portion of the resilient arm 6 on the casing 1, whereupon the button portion 82 is pressed down by a thumb force to shift the resilient arm 6 from the locked position that the resilient arm 6 is blocked up by the blocking stopper 74 to the unlocked position that the blocking up is released with respect to the blocking stopper 74. Preferably, the upper surface of the button portion 82 is scratched or slotted to prevent slipping during pressing or pushing the button portion 82.

In a preferred embodiment, the sliding cap 7 has a tab 76 having a radian greater than those of the other portions on the cover portion at the rear of the guiding slot 75, in order to facilitate to push down the sliding cap 7 when the safety button 82 is pressed down to release the blocking up of the sliding cap 7. There is a front portion at the front end of the sliding cap 7 for covering the fire hole, which may cover the fire hole of the casing in the locked position.

Figure 4:
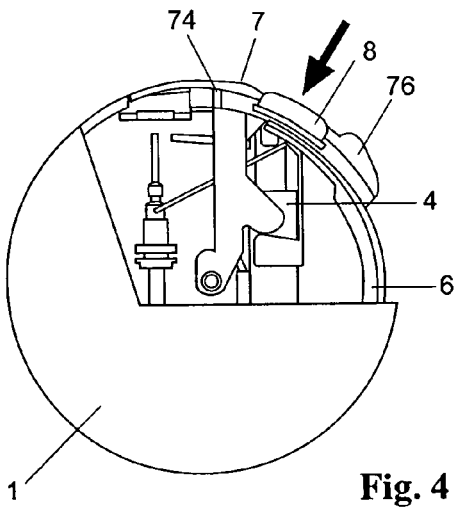
FIG. 4 is an operation step for the piezoelectric lighter with a safety lock according to the invention, showing a partially sectional view that the safety button of the piezoelectric lighter is pressed down by a thumb force.
Figure 5:
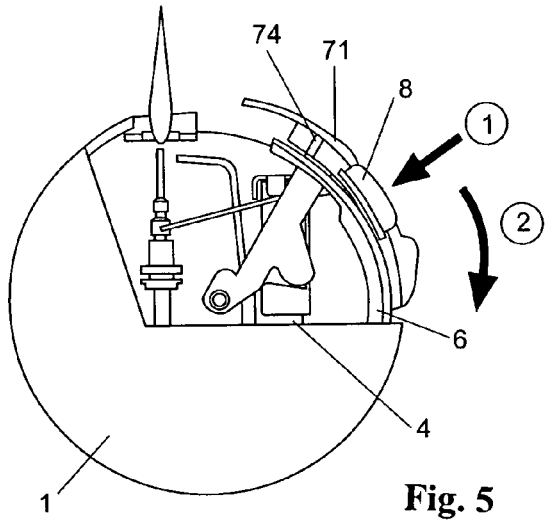
FIG. 5 is a second operation step for the piezoelectric lighter with a safety lock according to the invention, showing a partially sectional view that the ignition button is pushed to slide right and down to ignite the lighter at the same time of pressing down the safety button as shown in FIG. 4.

FIGS. 4 and 5 show the operation procedure and the ignition principle of the piezoelectric lighter with a safety lock in accordance with the present invention.

According to the invention, the operation procedure comprises two steps. The first step is to apply a thumb (on the button portion 82 of the safety button) to press down the safety button 8 in the static or locked position, as shown in FIG. 1, wherein the safety button 8 is moved down so that the base portion 81 thereof acts on the front portion of the resilient arm 6 and pushes the resilient arm 6 to bend radial-inwards and downwards about a fixed end thereof, to allow the front portion of the resilient arm 6 to descend below the bottom surface of the blocking stopper 74, which means the front portion of the resilient arm 6 is moved away from the opposite surface at one side of the stopper 74, i.e. in the unlocked position that the blocking up is released, the resilient arm 6 may then run through below the blocking stopper 74.

As shown in FIG. 5, the second step is, on the basis of the first step, to apply a force to slide down the sliding cap 7 till its terminal position, wherein, with the sliding down of the sliding cap 7 on the peripheral surface of the casing, the stands 72 rotates about the axle 10 to drive the branch arms 73 to be shifted down in a circular movement and to push down the horizontal legs 53 of the sliding member 5 and, as a result, the entire sliding cap is moved accordingly. The sliding member, provided at the end portion of the operating element 42, may also drive the operating element 42 of the piezoelectric unit to co-move down in a vertical direction to ignite the piezoelectric lighter.

After the completion of the ignition procedure, the thumb force applied on the sliding cap 7 is released. The sliding cap 7 and the safety button 8 will return by the spring forces of both the piezoelectric unit 4 and the resilient arm 6 back to the initial positions as shown in FIG. 1, i.e. the locked position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the utility model to the full extent indicated by the broad general meaning of the terms in which the appended claims are expressed.

What is claimed is:

1. A disk-shaped piezoelectric lighter with a safety lock including:

a casing receiving a liquefied gas storage and an ignition cavity provided therein, an arcuate opening being provided on a circumferential wall of the casing which is opposite to the ignition cavity;

a gas emitting nozzle installed in the casing and communicating with the liquefied gas storage for controlling a flow of the gas;

a piezoelectric unit comprising a frame-shaped piezoelectric member, a movable operating element extending upwards from the piezoelectric member and an ignition tip extending to a position adjacent to the gas emitting nozzle, said piezoelectric unit being received in the casing and installed on the liquefied gas storage;

a sliding member having an end cover portion, an extension wall extending downwards in a vertical direction from the end cover portion and a pair of horizontal legs symmetrically extending out vertically from the extension wall, said sliding member being movably mounted on the top of the piezoelectric unit or the operating element through the end cover portion in such a manner that the horizontal legs are movable up and down with the legs being positioned adjacent to two opposite surfaces of the frame-shaped piezoelectric member; and a safety lock comprising:

an arcuate resilient arm having an end secured on the wall of the casing at the side of the opening;

a sliding cap having an arcuate cover portion, a pair of forked stands extending downwards from the cover portion, a pair of branch arms each protruding outwardly from the side of the respective stand, a lateral blocking stopper located under the cover potion and between the two stands, and a guiding slot mounted on a top surface of the cover portion at the rear of the stopper, said sliding cap being mounted in a slidable or rotatable manner on the two opposite side walls of the liquefied gas storage by means of the stands, each of the two branch arms approaching or resting on the top end surfaces of the horizontal legs of the sliding member so that, when the stands are slid down, the branch arms may be shifted down in an arc movement, thus pushing the sliding member and by which driving the operating element to co-move vertically and downwardly to ignite the piezoelectric lighter, a front portion of the arcuate resilient arm on the casing, in a static or locked position of the lighter, being located in a traveling way of one side surface of the blocking stopper to block up the sliding-down of the sliding cap; and a safety button comprising a base portion and a button portion protruding upwards from the middle of the base portion, said safety button being mounted slidably up and down in the guiding slot of the sliding cap by means of the button portion, the base portion being positioned under the sliding cap so that the bottom surface of the base portion faces the surface of the arcuate resilient arm in a manner that the safety button, by application of a force to the button portion, pushes down the front portion of the arcuate resilient arm to deviate from the traveling way of the blocking stopper.

2. The disk-shaped piezoelectric lighter with a safety lock as claimed in claim 1, wherein the resilient arm secured on the wall of the casing at the side of the opening is boom-shaped, a gap is defined by each of two long side walls of the resilient arm and the edge of the arcuate opening on the casing, in which the stands are located movably, respectively.

3. The disk-shaped piezoelectric lighter with a safety lock as claimed in claim 1, wherein the sliding cap has a tab having a radian greater than those of the other portions on the cover portion at the rear of the guiding slot.

4. The disk-shaped piezoelectric lighter with a safety lock as claimed in claim 1, wherein the resilient arm is made of plastic materials.

5. The disk-shaped piezoelectric lighter with a safety lock as claimed in claim 1, wherein the casing is oblate or flat-polygonal.

6. The disk-shaped piezoelectric lighter with a safety lock as claimed in claim 1, wherein the blocking stopper has an arcuate bottom surface.

7. A disk-shaped piezoelectric lighter comprising:

a casing receiving a liquefied gas storage, the casing having an arcuate opening on a circumferential wall thereof;

a piezoelectric unit being received in the casing, the piezoelectric unit comprising a piezoelectric member, a movable operating element extending upwards from the piezoelectric member and an ignition tip extending to a position adjacent to the gas emitting nozzle; and a safety lock comprising:

an arcuate resilient arm having an end securedon the wall of the casing at the side of the opening;

a sliding cap having an arcuate cover portion, a lateral blocking stopper located under the cover potion and a guiding slot mounted on a top surface of the cover portion at the rear of the stopper, said sliding cap being mounted in a slidable or rotatable manner on the two opposite side walls of the liquefied gas storage, a front portion of the arcuate resilient arm on the casing, in a static or locked position of the lighter, being located in a traveling way of one side surface of the blocking stopper to block up the sliding-down of the sliding cap; and a safety button comprising a base portion and a button portion protruding upwards from the middle of the base portion, said safety button being mounted slidably up and down in the guiding slot of the sliding cap by means of the button portion, the base portion being positioned under the sliding cap so that the bottom surface of the base portion faces the surface of the arcuate resilient arm in a manner that the safety button, by application of a force to the button portion, pushes down the front portion of the arcuate resilient arm to deviate from the traveling way of the blocking stopper.

* * * * *